US012302982B2

(12) United States Patent
Dong

(10) Patent No.: US 12,302,982 B2
(45) Date of Patent: May 20, 2025

(54) SOLE STRUCTURE

(71) Applicant: Jianqiu Dong, Mengquan Town (CN)

(72) Inventor: Jianqiu Dong, Mengquan Town (CN)

( * ) Notice: Subject to any disclaimer, the term of this patent is extended or adjusted under 35 U.S.C. 154(b) by 131 days.

(21) Appl. No.: 18/334,521

(22) Filed: Jun. 14, 2023

(65) Prior Publication Data

US 2024/0358112 A1 Oct. 31, 2024

(30) Foreign Application Priority Data

Apr. 28, 2023 (CN) ..... 202310482602.4

(51) Int. Cl.
*A43B 13/18* (2006.01)
*A43B 13/16* (2006.01)

(52) U.S. Cl.
CPC ..... *A43B 13/16* (2013.01); *A43B 13/181* (2013.01); *A43B 13/186* (2013.01)

(58) Field of Classification Search
CPC ..... A43B 13/223
USPC ..... 36/102
See application file for complete search history.

(56) References Cited

U.S. PATENT DOCUMENTS

D813,503 S * 3/2018 Brunner ..... D2/908
2004/0154189 A1* 8/2004 Wang ..... A43B 13/12 36/28
2007/0199213 A1* 8/2007 Campbell ..... A43B 3/0057 36/102
2016/0219975 A1* 8/2016 Wright ..... A43B 13/04
2018/0295934 A1* 10/2018 Bernhard ..... A43B 13/181

FOREIGN PATENT DOCUMENTS

WO WO-2020108896 A1 * 6/2020 ..... A43B 13/125

OTHER PUBLICATIONS

English Translation of WO 2020/108896 (Heitz) (Year: 2020).*

* cited by examiner

*Primary Examiner* — Ted Kavanaugh
(74) *Attorney, Agent, or Firm* — JEEN IP LAW, LLC

(57) ABSTRACT

The present invention discloses a sole structure comprising a sole body provided on the bottom of a shoe, the sole body having a plurality of grooves arranged on the bottom surface of the sole body from front to rear, the grooves extending across the sole body from left to right; a dividing groove provided on the bottom surface of the sole body and staggered across the grooves. Two shock-absorbing areas are provided on the left and right sides of the dividing groove between the front and rear grooves, and hexagonal penetrated holes extend across the sole body from left to right within the shock-absorbing areas. A better shock-absorbing effect is achieved by using the dividing groove together with the grooves to form multiple independent shock-absorbing areas and dividing grooves that can absorb the shock independently and prevent twisting of the ankle.

2 Claims, 2 Drawing Sheets

SOLE STRUCTURE

FIELD OF INVENTION

The present invention relates to a sole structure.

BACKGROUND OF THE INVENTION

Prior art, such as the Chinese utility model patent document, publication number CN206525646U, discloses a shoe sole and a shoe comprising a honeycomb elastic layer provided between the sole layer and the upper layer, the honeycomb elastic layer being formed with a plurality of interconnected honeycomb through-holes, the honeycomb elastic layer being formed along the bottom surface of the upper layer so as to be divided to form a plurality of spaced-apart upper supports which are subjected to a pressure distributed on a honeycomb hole wall located below the upper support which at the same time pulls the peripheral honeycomb hole walls to rebound; and a sole head connected to one end of the honeycomb elastic layer and the upper layer. It features a simple structure, greatly reduces the material used, is comfortable, has sufficient elasticity, is light and effortless walking; and is not easily deformed, has low production cost, is lightweight, is durable, and so on. Therefore, it is a product with superior performance in economy and technology.

According to the above, in the prior art, by using a plurality of honeycomb through-holes, the shoe sole has good shock absorption and rebound performance. The existing honeycomb through-holes are from left to right through the shoe sole, although these through-holes can play a good shock absorption and rebound effect. However, since the entire honeycomb through-hole is integrated, and the left and right sides of the honeycomb through-hole have no sectional arrangement, as a result, in actual use, if one side of the through-hole encounters stone blockage and affect the deformation of the sole, the other side of the interconnected through-hole will also be affected.

SUMMARY OF THE INVENTION

The present invention is intended to solve at least one of the technical problems existing in the prior art. For this purpose, the present invention proposes a sole structure in which the shock-absorbing penetrated holes are provided in left and right sections to realize that the left and right shock absorbing do not affect each other.

A sole structure designed for this purpose, comprising a sole body provided on the bottom of a shoe, the sole body having a plurality of grooves arranged on the bottom surface of the sole body from front to rear and the grooves extending across the sole body from left to right, and a dividing groove is provided on the bottom surface of the sole body and staggered across the grooves. Two independent shock-absorbing areas are provided on the left and right sides of the dividing groove between the front and the rear grooves, and hexagonal penetrated holes are provided on the sole body within the shock-absorbing areas extending across the sole body from left to right.

Preferably, the dividing groove has more than two.

The present invention has the advantages of a simple and reasonable structure, independent shock-absorbing areas which do not affect each other and realize better shock absorption, compared to the prior art, a plurality of grooves are arranged on the bottom surface of the sole body from front to rear and the grooves extend across the sole body from left to right, and the dividing groove is provided on the bottom surface of the sole body and staggered across the grooves. Two independent shock-absorbing areas are provided on the left and right sides of the dividing groove between the front and the rear grooves, and the hexagonal penetrated holes are provided on the sole body within the shock-absorbing areas extending across the sole body from left to right. Using the dividing groove together with the grooves to form multiple independent shock-absorbing areas and the dividing grooves on the sole so that when stepping on stones or other hard materials in one shock-absorbing area, it will not affect other shock-absorbing areas, which is suitable for all kinds of uneven road, and each shock-absorbing area is independently shock absorbing and prevents twisting of the ankle, a better shock-absorbing effect is achieved.

DETAILED DESCRIPTION OF THE PREFERRED EMBODIMENTS

The present invention is further described below in conjunction with the accompanying drawings and embodiments.

Figure 1:
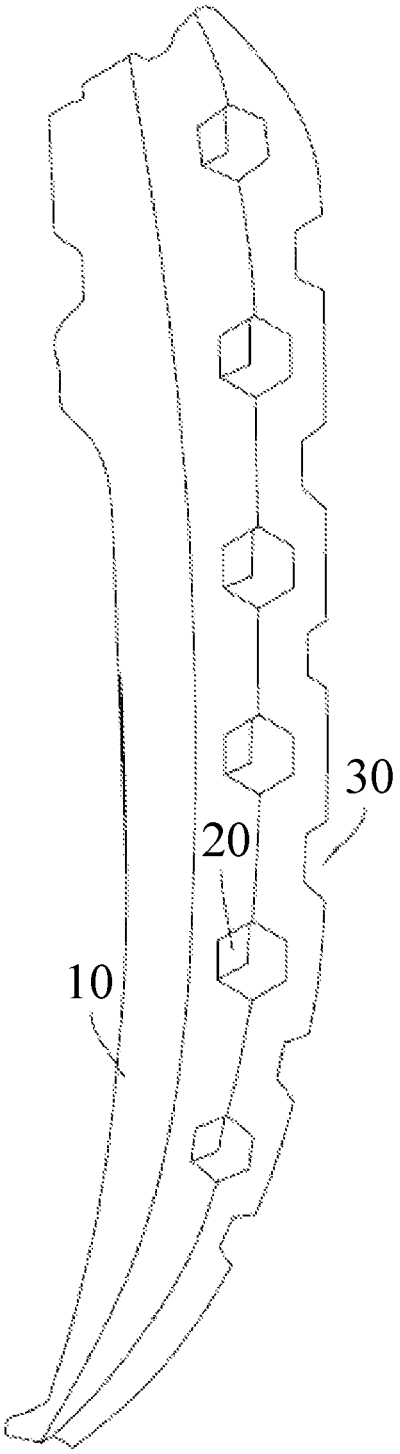
FIG. 1 is a schematic diagram of the side structure of the present invention.
Figure 2:
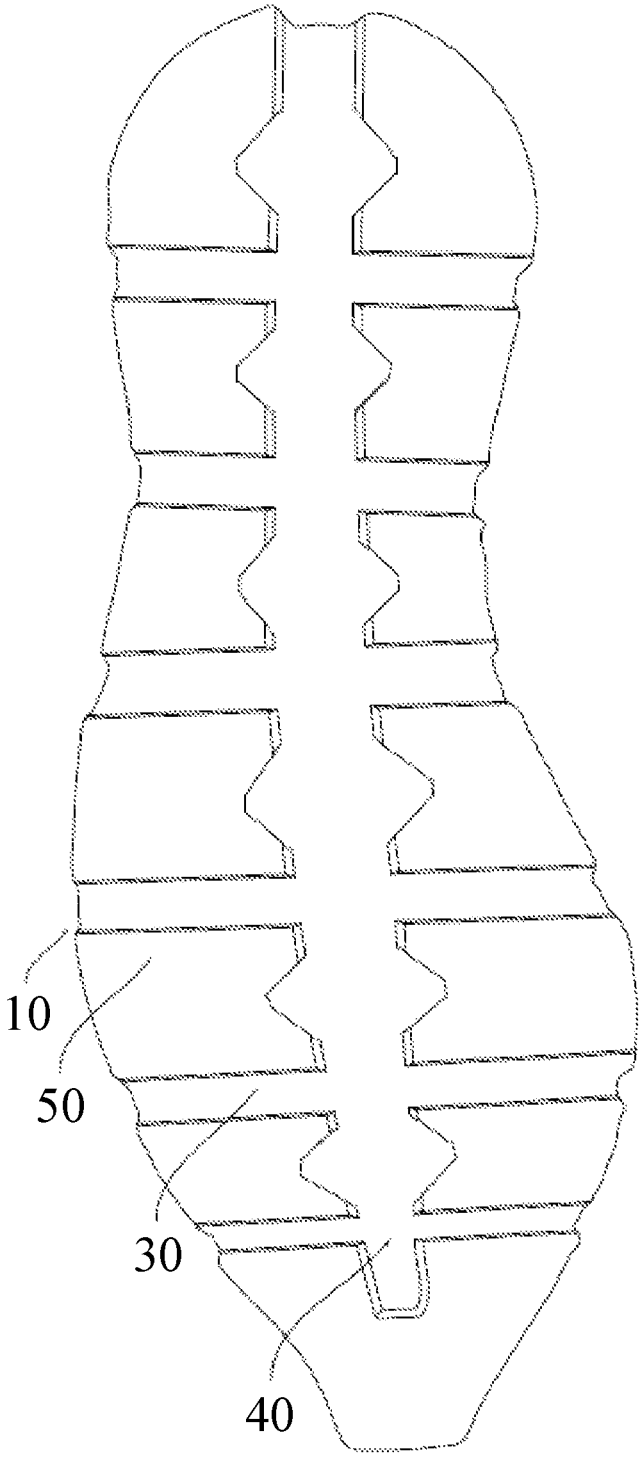
FIG. 2 is a schematic diagram of the bottom structure of the present invention.

Referring to FIGS. 1 to 2, a sole structure comprising a sole body 10 provided on the bottom of a shoe, a plurality of grooves 30 arranged on the bottom surface from front to rear of the sole body 10, and said grooves 30 extending across the sole body 10 from left to right; a dividing groove 40 provided on the bottom surface of the sole body 10 and staggered with the grooves 30. Two independent shock-absorbing areas 50 are provided on the left and right sides of the dividing groove 40 between the two grooves 30 from front to rear, and hexagonal penetrated holes 20 are provided on the sole body 10 within the shock-absorbing areas 50 extending across the sole body 10 from left to right.

The present invention uses the dividing groove together with the grooves to form multiple independent shock-absorbing areas and the dividing grooves on the sole so that when stepping on stones or other hard materials in one shock-absorbing area, it will not affect other shock-absorbing areas. To achieve a better shock-absorbing effect.

Specifically, the hexagonal penetrated holes 20 enable the sole in the shock-absorbing areas to have both a supportive as well as a shock-absorbing effect.

Specifically, the dividing groove 40 described has more than two. As the number of dividing grooves 40 increases, the more shock-absorbing areas 50 are available and the better the performance of their shock absorption.

Specifically, the front end of the dividing groove 40 extends into the forefoot of the sole body 10 in a closed configuration, and the rear end of the dividing groove 40 extends rearwardly through the sole body 10 in an open configuration. As shown in FIG. 2, the front end of the dividing groove 40 is located in the forefoot, which does not extend forwardly through the sole body 10, while on the rear side, the dividing groove 40 extends rearwardly through the entire sole body 10.

What is not described in detail in this specification belongs to the prior art that is well known to those skilled in the art.

In the description of the present invention, it is to be understood that the terms "center", "longitudinal", "transverse", "length", "width", "thickness", "top", "bottom", "front", "back", "left", "right", "vertical", "horizontal", "top", "bottom", "inside", "outside", "clockwise", "counterclockwise" and the like indicate orientation or positional relationships based on those shown in the accompanying drawings and are intended only to facilitate and simplify the description of the present invention rather than indicating or implying that the equipment or components referred to must have a particular orientation, be constructed and operated in a particular orientation, and therefore cannot be construed as a limitation of the present invention. The terms "first" and "second" are used for descriptive purposes only and are not to be construed as indicating or implying relative importance or implicitly specifying the number of technical features indicated.

The above shows and describes the basic principles and main features of the present invention and the advantages of the present invention. A person skilled in the art should understand that the present invention is not limited by the above embodiments and that the above embodiments and the description in the specification only illustrate the principles of the present invention, and that there will be various variations and improvements to the present invention without departing from the spirit and scope of the present invention, which falls within the scope of the present invention claimed for protection. The scope of protection claimed for the present invention is defined by the appended claims and their equivalents.

What is claimed is:

1. A sole structure comprising a sole body (10) provided on a bottom of a shoe, characterized in that: the sole body (10) having a plurality of grooves (30) arranged on a bottom surface of the sole body (10) from a front end to a rear end of the sole and the grooves (30) extending across the sole body (10) from left to right; at least one dividing groove (40) extending from the forefoot of the sole body (10) to the rear end of the sole is provided on the bottom surface of the sole body (10) and staggered across the grooves (30); two independent shock-absorbing areas (50) are provided on the left and right sides of the dividing groove (40) between any two adjacent grooves (30); and hexagonal penetrated holes (20) are provided on the sole body (10) within the shock-absorbing areas (50) extending across the sole body (10) from left to right and divided into two sections by the dividing groove (40).

2. The sole structure according to claim 1, is characterized in that: the front end of the dividing groove (40) extends into the forefoot of the sole body (10) and does not extend to the front end of the sole, and the rear end of the dividing groove (40) extends rearwardly through the sole body (10) and extends to the rear end of the sole.

* * * * *